US008401458B2

(12) United States Patent
Jang

(10) Patent No.: US 8,401,458 B2
(45) Date of Patent: Mar. 19, 2013

(54) IMAGE FORMING APPARATUS INCLUDING A REVERSING FEEDING UNIT

(75) Inventor: Heung-kyu Jang, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 445 days.

(21) Appl. No.: 12/685,119

(22) Filed: Jan. 11, 2010

(65) Prior Publication Data

US 2010/0178091 A1 Jul. 15, 2010

(30) Foreign Application Priority Data

Jan. 12, 2009 (KR) ..... 10-2009-0002400

Dec. 23, 2009 (KR) ..... 10-2009-0130073

(51) Int. Cl.
*G03G 15/00* (2006.01)

(52) U.S. Cl. ..... 399/405; 399/397

(58) Field of Classification Search ..... 399/405
See application file for complete search history.

(56) References Cited

U.S. PATENT DOCUMENTS

| | | | | |
|---|---|---|---|---|
| 4,814,825 | A * | 3/1989 | Johdai et al. | 271/65 |
| 5,854,965 | A * | 12/1998 | Kasiwabara et al. | 399/381 |
| 7,418,235 | B2 * | 8/2008 | Nonaka et al. | 399/401 |
| 7,493,062 | B2 * | 2/2009 | Igarashi | 399/111 |
| 7,577,395 | B2 * | 8/2009 | Baek et al. | 399/405 |
| 8,036,590 | B2 * | 10/2011 | Jang et al. | 399/405 |
| 2001/0028819 | A1 * | 10/2001 | Okamoto | 399/401 |
| 2009/0060613 | A1 * | 3/2009 | Matsuda et al. | 399/397 |
| 2009/0067909 | A1 * | 3/2009 | Kim et al. | 399/405 |

FOREIGN PATENT DOCUMENTS

| | | |
|---|---|---|
| JP | 05-105275 | 4/1993 |
| JP | 05-181331 | 7/1993 |

* cited by examiner

*Primary Examiner* — Anthony Nguyen
(74) *Attorney, Agent, or Firm* — Stanzione & Kim, LLP

(57) ABSTRACT

Disclosed is an image forming apparatus including a reverse-feeding unit. The reverse-feeding unit includes a frame which forms a first feeding path along which a printing medium is fed and a second feeding path which is branched off from the first feeding path, a guide plate which rotates between a first position in which the printing medium fed along the first feeding path is supported and a second position in which the supported printing medium is directed towards the second feeding path, and a plate driving unit which comprises an actuator which actuates the guide plate, a driving source which drives the actuator, and an electronic clutch which selectively transmits a driving force of the driving source to the actuator.

19 Claims, 7 Drawing Sheets

IMAGE FORMING APPARATUS INCLUDING A REVERSING FEEDING UNIT

CROSS-REFERENCE TO RELATED APPLICATIONS

This application claims priority from Korean Patent Applications No. 10-2009-0002400, filed on Jan. 12, 2009 and No. 10-2009-0130073 filed on Dec. 23, 2009 in the Korean Intellectual Property Office, the disclosure of which is incorporated herein by reference.

BACKGROUND

1. Field of the Invention

The present general inventive concept relates to a reverse-feeding unit to improve a printing speed and an image forming apparatus including the same.

2. Description of the Related Art

In general, an image forming apparatus prints a desired image on a printing medium using an ink or toner and includes a copier, a printer, a fax machine, a scanner and a multi-function printer. The image forming apparatus includes a printing unit for performing printing for a printing medium and a storage unit for storing the printing medium which is completely printed through the printing unit.

The storage unit is typically installed in a front upper part of the image forming apparatus so that a user can easily access the printed printing medium.

However, in the case that the printed printing medium is fed towards a front part and then to a rear part of the image forming apparatus for an image forming process, the printing medium should be fed to the storage unit installed in the front upper part after the image forming process.

In this respect, in order to feed the printing medium to the storage unit while maintaining a feeding direction of the printing medium towards the rear part of the image forming apparatus, the printing medium should be turned around towards the storage unit.

However, the turn around structure may have a curved structure to maintain the feeding direction of the printed printing medium, thereby to increase in height of the image forming apparatus.

Further, since the turn around structure makes a feeding path of the printing medium long, it takes a longer time to discharge the printing medium.

SUMMARY

The present general inventive concept provides a reverse-feeding unit which can provide a compact structure and an image forming apparatus including the same.

The present general inventive concept also provides a reverse-feeding unit which can reduce a feeding time of a printing medium and an image forming apparatus including the same.

The present general inventive concept also provides a reverse-feeding unit which can convert a feeding direction of a printing medium at a high speed without jamming and an image forming apparatus including the same.

Additional aspects of the present general inventive concept will be set forth in part in the description which follows and, in part, will be obvious from the description, or may be learned by practice of the present general inventive concept.

The foregoing and other features and utilities of the present general inventive concept may also be achieved by providing an image forming apparatus, including a main body, a printing unit which is contained in the main body and performs printing for a printing medium; a storage unit which is installed on an upper part of the main body and stores the printing medium printed through the printing unit, and a reverse-feeding unit which reversely feeds the printed printing medium to the storage unit, the reverse-feeding unit including a frame which forms a first feeding path along which a printing medium is fed and a second feeding path which is branched off from the first feeding path, a guide plate which rotates between a first position in which the printing medium fed along the first feeding path is supported and a second position in which the supported printing medium is directed towards the second feeding path, and a plate driving unit which includes an actuator which actuates the guide plate, a driving source which drives the actuator, and an electronic clutch which selectively transmits a driving force of the driving source to the actuator.

The first feeding path may extend between the printing unit and the guide plate.

The second feeding path may extend between the guide plate and the storage unit.

The reverse-feeding unit may be detachably coupled to the main body.

The apparatus may include a sensor unit which is installed in the first feeding path; and a controller which controls the plate driving unit based on a sensing result of the sensor unit.

The apparatus may include a first driving roller which feeds the printing medium along the second feeding path; and a contact unit which contacts the first driving roller with the printing medium being interposed therebetween when the guide plate is located in the second position and which separates from the first driving roller when the guide plate is located in the first position.

The contact unit may include at least one of an idle roller, a sliding unit and an elastic pad.

The contact unit may be installed in the guide plate.

The apparatus may include a second driving roller which rotates in a one-way direction and which feeds the printing medium along the first feeding path and feeds the printing medium supported by the guide plate along the second feeding path.

The first driving roller and the second driving roller may be driven by the driving source.

The apparatus may include a deviation prevention unit which prevents the printing medium supported by the guide plate from being deviated from the guide plate.

The actuator may include a cam.

The foregoing and other features and utilities of the present general inventive concept may also be achieved by providing an image forming apparatus, including a main body, a printing unit which is contained in the main body and performs printing for a printing medium, a frame to form portions of a first feeding path and a second feeding path, a guide plate to form another portions of the first feeding path and the second feeding path and to move between a first position with the portion and another portion of the first feeding path and a second position to feed the printing medium from the first feeding path toward the second feeding path of the frame, and a contact unit disposed on the guide plate to lift the printing medium from a portion of the guide plate.

The reverse-feeding unit may further include a deviation prevention unit disposed between the frame and the contact unit to bias the printing medium toward the guide plate.

The reverse-feeding unit may further include a roller disposed to feed the printing medium toward the frame in the second feeding path with the contact unit when the guide plate is in the second position.

The guide plate may move with respect to a portion of the guide plate, the first feeding path may be extended from the portion of the frame to the portion of the guide plate in the first position, and the second feeding path may be extended from the portion of the guide plate to the portion of the frame.

The another portions of the first feeding path and the second feeding path may include a common path formed on the guide plate.

The another portions of the first feeding path and the second feeding path may form an angle to correspond to a difference between the first position and the second position of the guide plate.

The image forming apparatus may include a main body with a first side and a second side, and the reverse-feeding unit receives the printing medium along the first feeding path from the first side toward the second side of the main body and discharges the printing medium along the second feeding path from the second side to the first side of the main body.

The foregoing and other features and utilities of the present general inventive concept may also be achieved by providing an image forming apparatus, including a housing, a printing unit to print a printing medium and to feed the printed printing medium from a first side of the housing to a second side of the housing, and a reverse-feeding unit disposed between the first side and the second side of the housing to receive the printed printing medium from the printing unit and to discharge toward the first side of the housing, the reverse-feeding unit including a frame to form portions of a first feeding path and a second feeding path, a guide plate to form another portions of the first feeding path and the second feeding path and to move between a first position with the portion and another portion of the first feeding path and a second position with the to feed the printing medium from the first feeding path toward the second feeding path of the frame, and a contact unit disposed on the guide plate to lift the printing medium from a portion of the guide plate.

With this configuration, the reverse-feeding unit and the image forming apparatus according to the present general inventive concept can provide a compact structure, can reduce feeding time of the printing medium to increase a printing speed and can convert a feeding direction of the printing medium without jamming.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
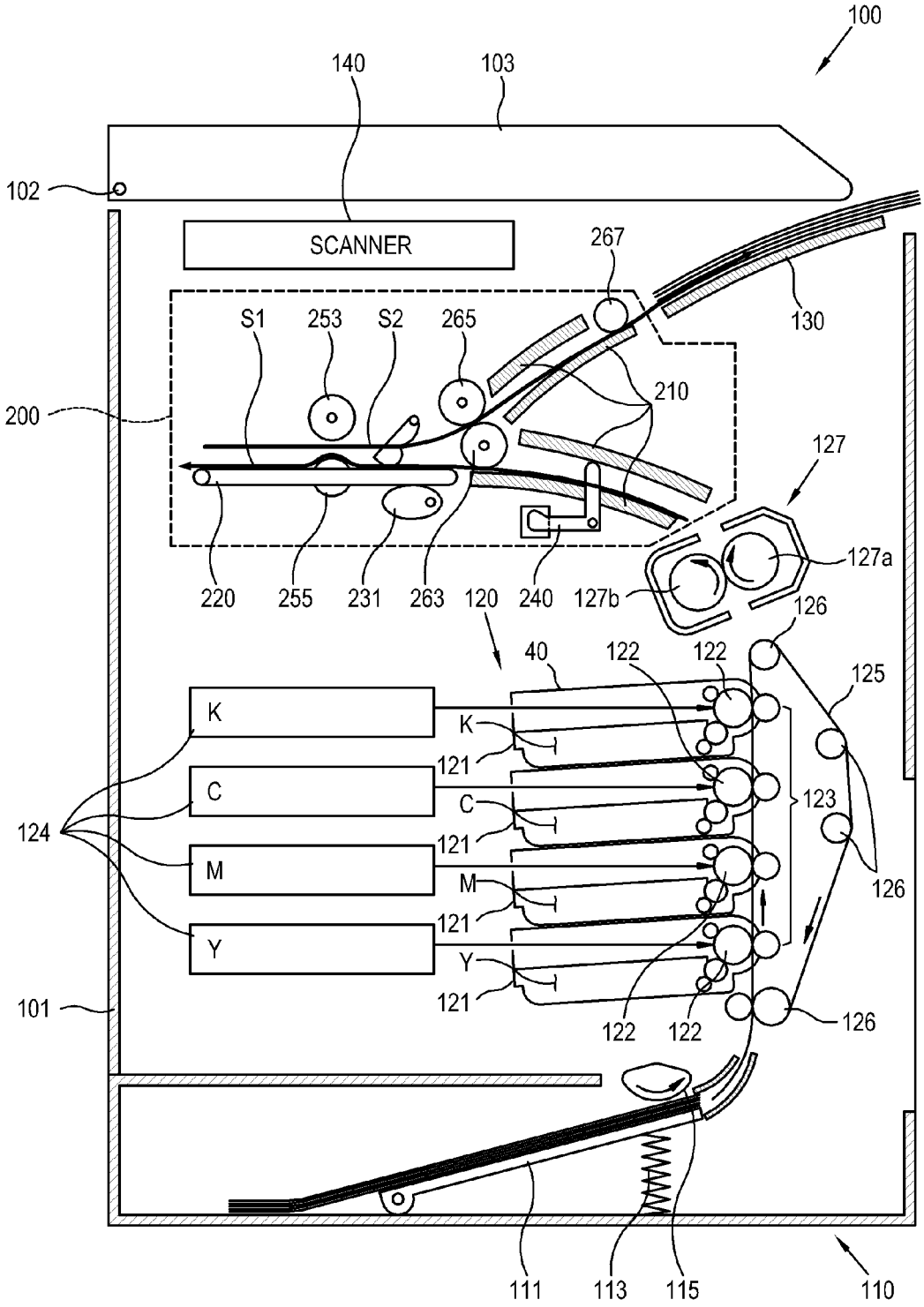
FIG. 1 is a schematic sectional view illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Redundant description to different embodiments may be omitted for simplicity of description as necessary.

As shown in FIG. 1, an image forming apparatus 100 according to an exemplary embodiment of the present general inventive concept includes a printing unit 120 which is contained in a main body 101 and performs printing for a printing medium, a storage unit 130 which is installed in a front upper part of the main body 101 and stores the printing medium printed through the printing unit 120, and a reverse-feeding unit 200 which reversely feeds the printed printing medium to the storage unit 130.

The printing unit 120 may adopt electrophotographic printing. Since the electrophotographic printing is well known, detailed description thereof will be omitted.

As shown in FIG. 1, the printing unit 120 includes a plurality of developing cartridges 121, a plurality of light exposure units 124 each corresponding to the plurality of developing cartridges 121, a plurality of transfer rollers 123 which transfers an image formed on image supports 122 contained in the plurality of developing cartridges 121 to a printing medium, a feeding belt 125, a plurality of driving rollers 126 which drives the feeding belt 125, and a fusing unit 127.

The plurality of developing cartridges 121 may have a housing 40 to respectively support therein a developer (toner) of yellow (Y), magenta (M), cyan (C) and black (K) and contains the image support 122 therein.

The plurality of light exposure units 124 exposes the image supports 122 in the corresponding developing cartridges 121. Accordingly, the developer in the developing cartridges 121 is coated in light exposure regions on the image support 122, thereby forming a visible image on the surface thereof. The housing may include a hole through which light emitted from a corresponding one of the light exposure units 124 can pass through toward the corresponding image support 122.

The feeding belt 125 feeds the printing medium supplied from a supply unit 110 to pass through the image supports 122 and the transfer rollers 123.

Accordingly, the visible image formed on the surface of each image support 122 is transferred to the printing medium on the feeding belt 125 by the transfer roller 123. As the printing medium sequentially passes through the image supports 122 and the transfer rollers 123, the visible images having yellow, magenta, cyan and black are superposedly transferred onto the printing medium. Accordingly, a color visible image is formed on the printing medium.

The color visible image is fused on the printing medium through the fusing unit 127. The fusing unit 127 includes a heating roller 127*a* to heat the color visible image, and a press roller 127*b* to press the printing medium towards the heating roller 127*a*.

By passing the fusing unit 127, the printing process for the printing medium is completed.

The printing unit 120 may adopt different printing types instead of or together with the electrophotographic type. For example, the printing unit 120 may adopt at least one of an inkjet printing to discharge an ink through a nozzle and a heat transfer printing using a thermal printing head (TPH).

The image forming apparatus 100 may further include the supply unit 110 to supply the printing medium to be printed to the printing unit 120.

The supply unit 110 may be detachably coupled to the main body 101 to recharge the printing medium in the case that the printing medium is completely consumed.

The supply unit 110 includes a knock-up plate 111 to load the printing medium to be printed; a pick-up roller 115 for picking up the printing medium on the knock-up plate 111 to the printing unit 120; and an elastic member for elastically biasing the knock-up plate 111 towards the pick-up roller 115.

As illustrated in FIGS. 1, 2, 3A, 3B, and 3C, the reverse-feeding unit 200 includes a frame 210, a guide plate 220, and a plate driving unit 230.

The frame 210 includes sub frames 210*a* and 210*b* to form a portion S1*a* of a first feeding path S1 along which the printing medium passed the printing unit 120 is fed, and sub frames 210*c* and 210*d* to form a portion S2*a* of a second feeding path S2 which is branched off from the first feeding path S1. In this respect, the first feeding path S1 connects the printing unit 120 and the guide plate 220, and the second feeding path S2 connects the guide plate 220 and the storage unit 130. That is, the first feeding path S1 extends from the printing unit 120 to the guide plate 220 toward a portion S1*b* of the first feeding path S1 through a portion S1*a*. The second feeding path S2 extends from the guide plate 220 to the storage unit 130 toward a portion S2*a* of the second feeding path S2 through a portion S2*b*.

Figure 3A:
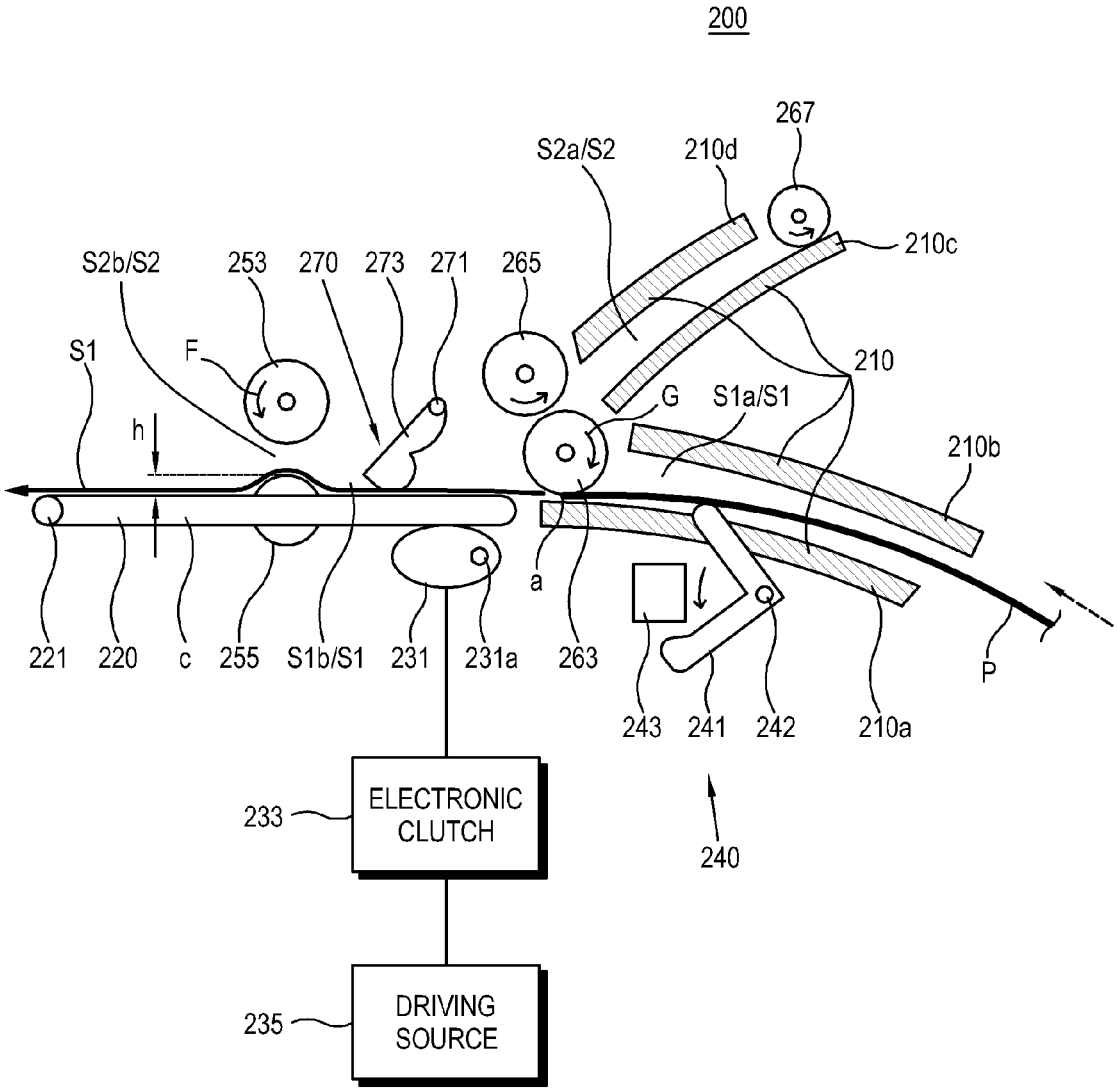
FIGS. 3A to 3C are schematic sectional views illustrating a feeding procedure of a printing medium in a reverse-feeding unit of the image forming apparatus in FIG. 1.
Figure 3B:
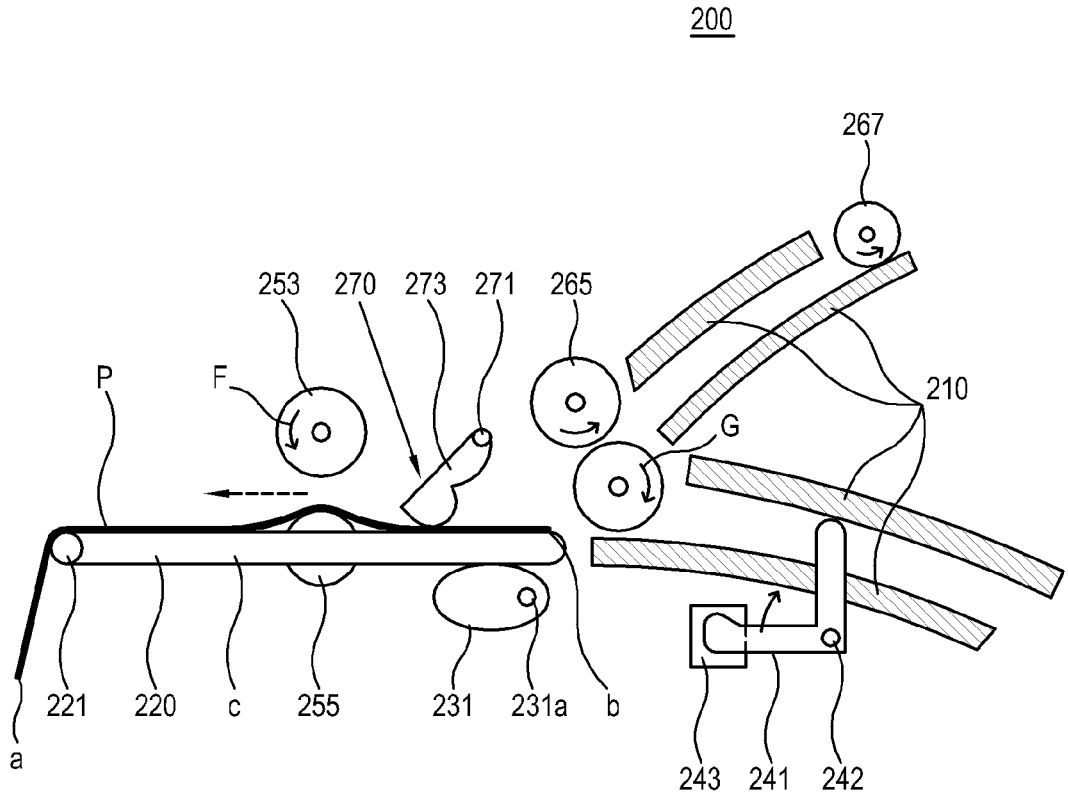
Figure 3C:
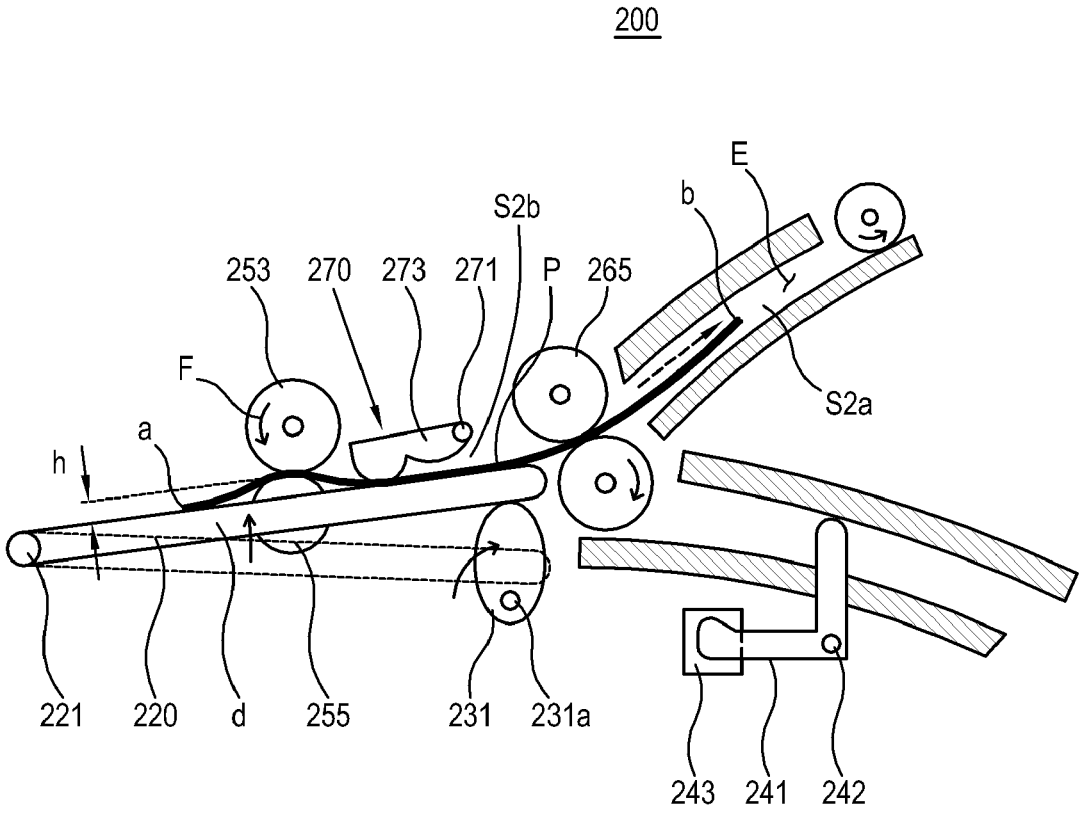

As illustrated in FIGS. 3A and 3C, the guide plate 220 may rotate between a first position c in which the printing medium P fed along the first feeding path S1 from the portion S1*a* to the portion S1*b* is supported and a second position d in which the printing medium P supported on the guide plate 220 is directed towards the second feeding path S2 from the portion S2*b* to the portion S2*a*.

The guide plate 220 may rotate around a hinge shaft 221 installed in a downstream of the first feeding path S1.

More specifically, an end part of the guide plate 220 is coupled to the hinge shaft 221, and the other end part of the guide plate 220 is supported by an actuator 231.

The first feeding path S1 may be formed with the sub frames 210*a* and 210*b* of the frame 210 and the guide plate 220 in the first position c, and the second feeding path S2 may be formed with the sub frames 210*c* and 210*d* of the frame 210 and the guide plate 220 in the second position d. The guide plate 220 may forma a common path for the first feeding path S1 and the second feeding path S2. When the guide plate 220 moves by a distance between the first position c and the second position d or rotates by an angle between the first position c and the second position d, the first feeding path S1 and the second feeding path S2 may form the same distance or the same angle with respect to each other. Portions S1*b* and S2*b* of the first and second feeding paths S1 and S2 may be parallel to a surface of the guide plate 220. Another portions S1*a* and S2*a* of the first and second feeding paths S1 and S2 may not be parallel to the portions S1*b* and S2*b* of the first and second feeding paths S1 and S2, respectively. The another portions S1*a* and S2*a* of the first and second feeding paths S1 and S2 may have be curved with respect to the portions S1*b* and S2*b* of the first and second feeding paths S1 and S2, respectively.

Figure 2:
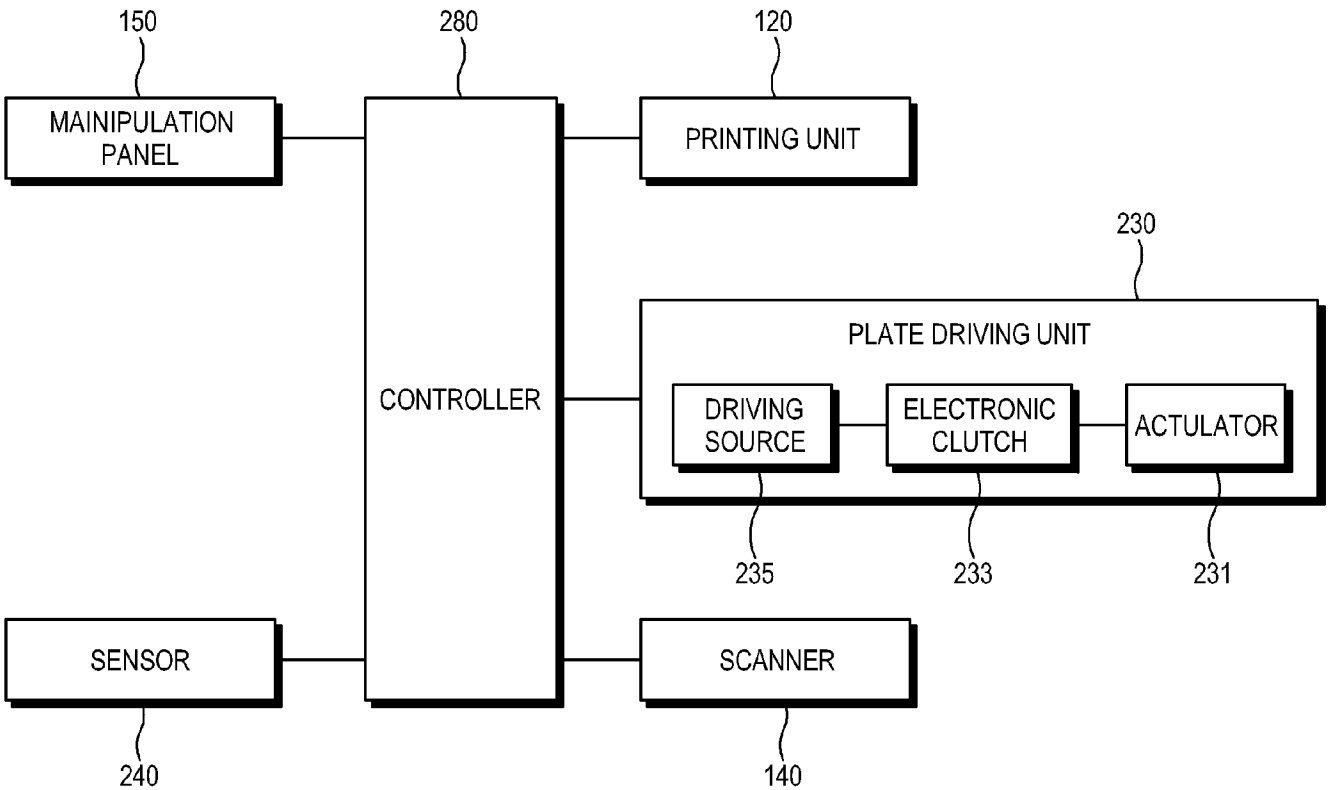
FIG. 2 is a block diagram illustrating the image forming apparatus in FIG. 1.

As illustrated in FIGS. 1 and 2, the plate driving unit 230 includes the actuator 231 to rotate the guide plate 220, a driving source 235 to drive the actuator 231; and an electronic clutch 233 to selectively transmit a driving force of the driving source 235 to the actuator 231.

The actuator 231 may be a cam which rotates around a cam shaft 231*a* in a one-way direction. However, the present general inventive concept is not limited thereto. It is possible that different driving units can be used as the actuator 231 to ascend and/or descend the guide plate 220.

Further, the reverse-feeding unit 200 includes a sensor to detect a position of the printing medium P with respect to the frame 210. The sensor may be a sensor unit 240 installed in the first feeding path S1, and a controller 280 which controls the plate driving unit 230 based on a sensing result of the sensor 240.

Hereinafter, a feeding procedure that the printed printing medium is fed to the storage unit 130 along the first feeding path S1 and the second feeding path S2 will be described with reference to FIGS. 3A to 4.

As illustrated in FIG. 3A, the sensor unit 240 includes a lever 241 which contacts the printing medium P fed along the portion S1*a* of the first feeding path S1, and a photo-sensor 243 having a light emitting part to emit light and a light receiving part to receive the light or to not receive the light when the light is blocked according to a position of the lever 241.

The lever 241 may rotate around the hinge shaft 242 between a blocking position (FIG. 3B) in which the light from the light emitting part is blocked and a releasing position (FIG. 3A) in which is spaced from the blocking position to allow the light to pass through toward the light receiving part of the photo-sensor 243.

In this respect, the sensor unit 240 may further include an elastic member (not illustrated) to elastically bias the lever 241 to maintain the blocking position.

Specifically, when the printing medium comes in contact with the lever 241, the lever 241 rotates to the releasing position shown in FIG. 3A. Accordingly, the light from the light emitting part is received to the light receiving part, and thus, the photo-sensor 243 outputs an 'ON' signal. To the contrary, when the printing medium does not come in contact with the lever 241, the lever 241 is located in the blocking position shown in FIGS. 1, 3B and 3C by the elastic member (not shown). Accordingly, as the light from the light emitting part is blocked to the light receiving unit, the photo-sensor 243 outputs an 'OFF' signal.

Figure 4:
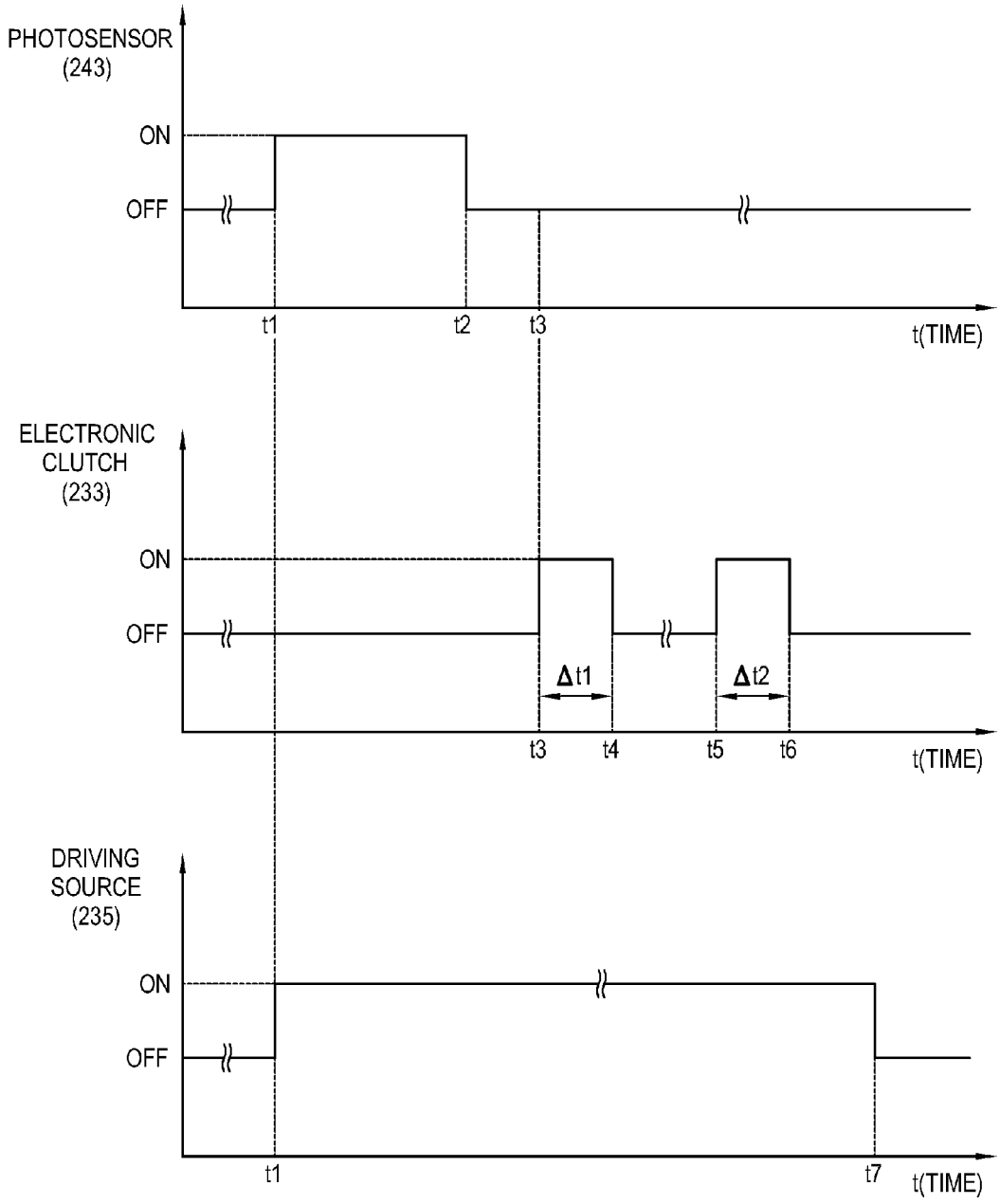
FIG. 4 is a timing diagram illustrating a photo-sensor, an electronic clutch and a driving source of the image forming apparatus in FIG. 1.

As illustrated in FIG. 4, in the case that the signal of the photo-sensor 243 is switched into 'ON' from 'OFF' in a time point t1, this means that an end part a of the printing medium P comes in contact with the lever 241 in the point t1 to thereby rotate the lever 241. In the case that the signal of the photo-sensor 243 is switched into 'OFF' from 'ON' in a point t2, this means that the other end part b of the printing medium P has just passed the lever 241 in the point t2, as shown in FIG. 3B.

The controller 280 may control the electronic clutch 233 based on the sensing result of the sensor unit 240.

More specifically, the controller 280 turns off the electronic clutch 233 until the other end part b of the printing medium which is fed along the first feeding path 51 is supported by the guide plate 220. Accordingly, the driving force of the driving source 235 is not transmitted to the actuator 231, and thus, the guide plate 220 is located in the first position (c in FIG. 3A).

The controller 280 may determine a point t3 in which the other end part b of the printing medium P is supported by the guide plate 220 based on the sensing signal of the photo-sensor 243.

More specifically, the controller 280 may determine a point that a predetermined time elapses from the point t2 in which the signal of the photo-sensor 243 is switched into 'OFF' from 'ON' as the point t3 in which the other end part b of the printing medium P is supported by the guide plate 220.

In this respect, the predetermined time may be calculated based on a time taken for the other end part b of the printing medium P moving along the first feeding path 51 to pass the distance between the lever 141 and the guide plate 220.

The controller 280 turns on the electronic clutch 233 for a predetermined time t1 after a point in which the other end part b of the printing medium P is supported by the guide plate 220, for example, after the point t3.

As the driving force of the driving source 235 is transmitted to the actuator 231 during the predetermined time Δt1, the guide plate 220 moves to the second position (d in FIG. 3C).

Accordingly, the printing medium P supported by the guide plate 220 is directed towards the second feeding path S2 for the storage unit 130.

As described above, since the feeding direction of the printing medium can be simply converted by an ON/OFF operation of the electronic clutch, the printing medium can be smoothly discharged.

Further, as the guide plate 220 has a small radius of rotation between the first position c and the second position d, the feeding direction of the printing medium can be quickly converted.

As illustrated in FIGS. 1, 3A to 3C, the reverse-feeding unit 200 may further include a first driving roller 253 which feeds the printing medium P supported by the guide plate 220 along the second feeding path S2.

Further, the reverse-feeding unit 200 may include a contact unit 255 which selectively contacts the first driving roller 253 or separates from the first driving roller 253.

The contact unit 255 may have various shapes as long as the contact unit 255 comes in contact with the first driving roller 253 with the printing medium P being interposed therebetween, in order to feed the printing medium P towards the second feeding path S2. In FIG. 3A, an idle roller is illustrated as an example of the contact unit 255. Alternatively, the contact unit 255 may be provided as a sliding unit (not illustrated) or an elastic pad (not illustrated). The elastic pad (not illustrated) may be made of a sponge or a soft plastic member.

Further, the contact unit 255 may be installed to the guide plate 220. For example, as shown in FIGS. 1 and 3A, the idle roller 255 may be rotatably supported by the guide plate 220.

Furthermore, the guide plate 220 may perform the function of the contact unit 255 without the idle roller 255.

As illustrated in FIG. 3A, when the guide plate 220 is located in the first position c, the contact unit 255 is separated from the first driving roller 253. Accordingly, the printing medium P moving along the first feeding path S1 can pass between the first driving roller 253 and the contact unit 255.

The contact unit 255 may protrude from the guide plate 220 by a height h. That is, the contact unit may have a height h with respect to a surface of the guide plate 220 forming the portion S1*b* of the first feeding path S1. The height h may be lower than a maximum height change of the guide plate 220 when the guide plate 220 moves or rotates between the positions c and d. However, the present general inventive concept is not limited thereto. The height h may be higher than the maximum height change of the guide plate 220.

The contact unit 255 may be disposed between ends of the guide plate 220. It is possible that the contact unit 255 can be disposed a middle position of the guide plate 220. It is also possible that the contact unit 255 is disposed closer to an end of the guide plate 220 disposed adjacent to the sub frames 210*a* and 210*b* as the portion S1*a* of the first feeding path S1, than the other end of the guide plate 220 adjacent to the rear part of the image forming apparatus.

Here, as illustrated in FIG. 3A, the reverse-feeding unit 200 may further include a deviation prevention unit 270 to prevent the printing medium P supported by the guide plate from being deviated from the guide plate 220.

The deviation prevention unit 270 includes a pressing lever 273 to face the guide plate 220 with the printing medium P moving along the first feeding path S1 being interposed therebetween. The deviation prevention unit 270 may further include an elastic member (not illustrated) to elastically bias the pressing lever 273 towards the guide plate 220.

The deviation prevention unit 270 may be disposed between the contact unit 255 and the sub frames 210*a* and 210*b* or between the contact unit 255 and the sub frames 210*c* and 210*d*. When the contact unit 255 protrudes from the guide plate 220, an end of the deviation prevention unit 270 may be in a position between the surface of the guide plate 220 and the height h of the contact unit 255. The printing medium P can be guided by the contact unit 255 and the deviation prevention unit 270 between the portion S2*b* and the portion S2*a* or between the portion S1*b* and the portion S1*a*. It is possible that the printing medium may have a portion which is curved with respect to the surface of the guide plate 220 by the contact unit 255 and the deviation prevention unit 270.

As illustrated in FIG. 3B, the printing medium P moving along the first feeding path S1 passes between the first pressing lever 273 and the guide plate 220. As shown in FIG. 3C, since the printing medium P disposed between the pressing lever 273 and the guide plate 220 is pressed by the pressing lever 273 even though the guide plate 220 is inclined, the printing medium does not deviate from the guide plate 220.

Here, the elastic force of the elastic member (not illustrated) to elastically bias the pressing lever 273 towards the guide plate 220 may be determined in such a range that does not cause severe interruption to the feeding of the printing medium P and that prevents a deviation of the printing medium P.

Further, as illustrated in FIGS. 1, 3A to 3C, the reverse-feeding unit 200 may further include a second driving roller 263.

The second driving roller 263 rotates in a one-way direction G and feeds the printing medium P along the first feeding path 51, and then feeds the printing medium P supported by the guide plate 220 along the second feeding path S2.

As illustrated in FIG. 1, the second driving roller 263 may be arranged in a region in which the second feeding path S2 is branched off from the first feeding path 51.

The first driving roller 253 and/or the second driving roller 263 may be driven by the driving source 235. Alternatively, the first driving roller 253 and/or the second driving roller 263 may be driven by a driving source different from the driving source 235.

The controller 280 may control the driving source 235 to drive the first driving roller 253 and the second driving roller 263 based on the sensing result of the sensor unit 240.

More specifically, if it is determined that the end part a of the printing medium P passes the sensor unit 240 based on the sensing result of the sensor unit 240, the controller 280 turns on the driving unit 235.

In this respect, between the driving source 235, and the first driving roller 253 and the second driving roller 263 is installed a gear unit (not illustrated) for respectively transmitting the driving force of the driving source 235 to the first driving roller 253 and the second driving roller 263. Accordingly, the first driving roller 253 rotates in a direction F for feeding the printing medium P to the second feeding path S2; and the second driving roller 263 rotates in the direction G.

In this way, the first driving roller 253 and the second driving roller 263 can respectively rotate in the directions F and G without any clutch, and accordingly, the manufacturing cost may be reduced.

Further, since it is not necessary to change the rotational direction of the driving shaft of the driving source 235 while the printing medium P is moving along the first feeding path S1 and the second feeding path S2, the printing medium P may be discharged at a high speed.

As illustrated in FIG. 3A, the printing medium P moving along the first feeding path S1 is not interrupted by the rotation of the first driving roller 253 as the guide plate 220 and the second driving roller 253 forms a space which is large enough to allow the printing medium to pass therethrough even though the first driving roller 253 rotates in the direction F.

Further, since the deviation prevention unit 270 is provided in at least one of the first feeding path S1 and the second feeding path S2, the interruption by the one-way direction of the first driving roller 253 can be prevented by generating a bias force to be applied to the printing medium P toward the surface of the guide plate 220. Accordingly, as illustrated in FIG. 3B, the printing medium P may be supported by the guide plate 220 up to the other end part b.

As described above, after the time point in which the end part b of the printing medium is supported by the guide plate 220, for example, after the point t3, the electronic clutch 233 is turned on for the predetermined time Δt1.

Accordingly, as illustrated in FIG. 3C, the guide plate 220 moves to the second position d and the contact unit 255 installed in the guide plate 220 comes in contact with the first driving roller 253 with the printing medium P being interposed therebetween. As the first driving roller 253 rotates in the direction F, the printing medium P is reversely fed along the second feeding path S2.

Here, the reverse-feeding unit 200 may further include a discharging roller 267 installed in a downstream of the second feeding path S2.

The printing medium P which is reversely fed along the second feeding path S2 moves to the discharging roller 267 by the second driving roller 263 and a driven roller 265 driven by the second driving roller 263.

The discharging roller 267 discharges the printing medium P to the storage unit 130.

If it is determined that the other end part a of the printing medium P comes out of the guide plate 220 along the second feeding path S2, the controller 280 may turn on the electronic clutch 233 for a predetermined time Δt2 from t5 to t6. Accordingly, the guide plate 220 located in the second position (d in FIG. 3C) may return to the first position (c in FIG. 3C).

In this way, the guide plate 220 can quickly return to the first position (c in FIG. 3C), and accordingly, the next printing medium may be fed to the guide plate 220 even though the current printing medium P does not completely come out of the second feeding path S2.

In this respect, the point t5 may be estimated on the basis of a rotational speed of the first driving roller 253 and the second driving roller 263 after the real sensing point t2.

According to another exemplary embodiment of the present general inventive concept, a sensor unit to sense the printing medium may be further installed in a section of the second feeding path S2 between the second driving roller 263 and the discharging roller 267, to thereby control the electronic clutch 233 based on a sensing result of the sensor unit. In this case, the sensor unit may be of the same type as the sensor unit 240.

In the case that the plurality of printing mediums P is printed, the controller 280 may turn off the driving source 235 after the final printing medium P is discharged through the discharging roller 267, for example, in a time point t7.

Further, the image forming apparatus 100 may further include a cover 103 which is coupled to the main body 101 to rotate around a hinge shaft 102.

The image forming apparatus 100 may further include a scanner 140 which is installed under the cover 103 to scan an image of a document.

The image data acquired by the scanner 140 may be printed by the printing unit 120.

In the above-described embodiment, the controller 280 is included in the reverse-feeding unit 200, but the controller 280 may not be included in the reverse-feeding unit 200.

For example, a control signal for controlling the driving source 235 and the electronic clutch 233 may be received from the outside of the reverse-feeding unit 200, that is, a controller (not illustrated) provided in the image forming apparatus 100. In this case, the reverse-feeding unit 200 may include an input port for receiving the control signal and may be detachably provided to the main body 101.

As illustrated in FIG. 2, the image forming apparatus 100 may further include a manipulation panel 150 installed in a front upper part of the main body 101. The manipulation panel 150 includes an input window (not illustrated), and an input key (not illustrated) such that a user can enter a signal to be used in scanning or printing process of the image forming apparatus using the input window or the input key. A user may receive information about the image forming apparatus 100 and input a copy command or a printing command through the manipulation panel 150.

Figure 5:
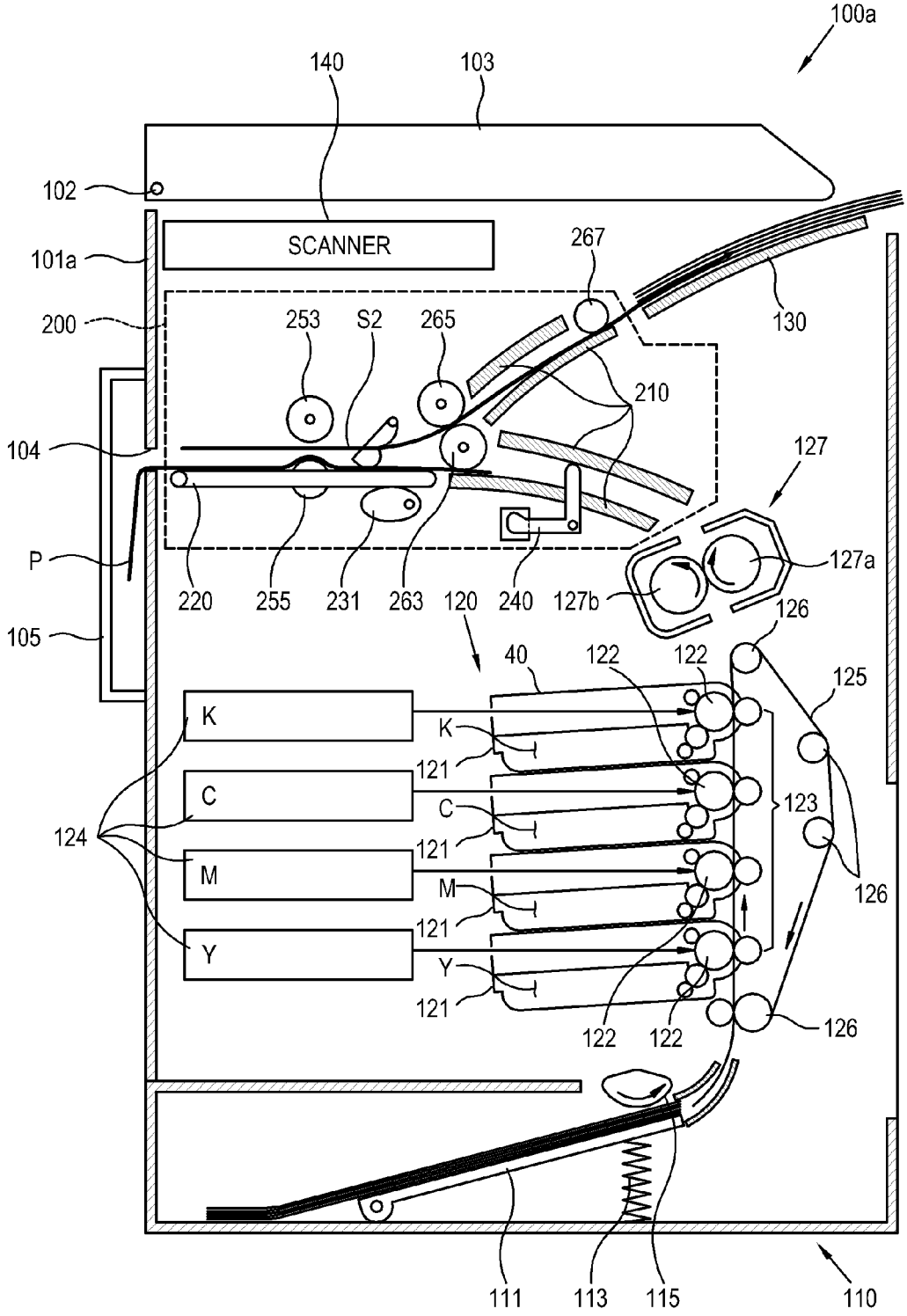
FIG. 5 is a schematic sectional view illustrating an image forming apparatus according to another exemplary embodiment of the present general inventive concept

As illustrated in FIG. 5, an image forming apparatus 100*a* according to another exemplar embodiment may include a main body 101*a* having a through hole 104 through which a printing medium P can pass, and a hole cover 105 to cover the through hole 104. Here, the hole cover 105 may be omitted in consideration of a compact size of the image forming apparatus 100*a*, etc.

An leading edge of the printing medium P may be transferred along the first feeding path S1 (refer to FIG. 1) by the second driving roller 263 to pass through the through hole 104 and then get out of the main body 101*a*. The size and weight of the image forming apparatus 100*a* can be reduced by arranging a portion of the feeding path of the printing medium outside the main body 101*a*, as compared with the feeding path fully disposed inside the main body 101*a*.

Even though a portion of the printing medium P gets out of the main body 101*a* through the through hole 104, the printing medium P can not be deviated from the guide plate 220 by the deviation prevention unit 270.

In addition, the hole cover 105 may be installed to the main body 101*a* detachably. For example, the hole cover 105 can be mounted rotatably on a hinge shaft (not shown) which is provided on the main body 101*a* or can be installed to the main body 101*a* by hook coupling type or fit-in coupling type.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a main body;

a printing unit which is contained in the main body and performs printing for a printing medium;

a storage unit which is installed on an upper part of the main body and stores the printing medium printed through the printing unit; and a reverse-feeding unit which reversely feeds the printed printing medium to the storage unit, the reverse-feeding unit comprising:

a frame which forms a first feeding path along which a printing medium is fed and a second feeding path which is branched off from the first feeding path;

a guide plate which rotates between a first position in which the printing medium fed along the first feeding path is supported and a second position in which the supported printing medium is directed towards the second feeding path; and a plate driving unit which comprises an actuator which actuates the guide plate, a driving source which drives the actuator, and an electronic clutch which selectively transmits a driving force of the driving source to the actuator and interlockingly rotates the actuator with non-gear structure.

2. The apparatus according to claim 1, wherein the first feeding path extends between the printing unit and the guide plate; and the second feeding path extends between the guide plate and the storage unit.

3. The apparatus according to claim 1, wherein the reverse-feeding unit is detachably coupled to the main body.

4. The apparatus according to claim 1, wherein the reverse-feeding unit further comprises:

a sensor unit which is installed in the first feeding path; and a controller which controls the plate driving unit based on a sensing result of the sensor unit.

5. The apparatus according to claim 1, wherein the reverse feeding unit further comprises: a first driving roller which feeds the printing medium along the second feeding path; and a contact unit which contacts the first driving roller with the printing medium being interposed therebetween when the guide plate is located in the second position and which separates from the first driving roller when the guide plate is located in the first position.

6. The apparatus according to claim 5, wherein the contact unit comprises at least one of an idle roller, a sliding unit and an elastic pad.

7. The apparatus according to claim 5, wherein the contact unit is installed in the guide plate.

8. The apparatus according to claim 5, wherein the reverse-feeding unit further comprises a second driving roller which rotates in a one-way direction and which feeds the printing medium along the first feeding path and feeds the printing medium supported by the guide pate along the second feeding path.

9. The apparatus according to claim 8, wherein the first driving roller and the second driving roller are driven by the driving source.

10. The apparatus according to claim 1, wherein the reverse feeding unit further comprises a deviation prevention unit which prevents the printing medium supported by the guide plate from being deviated from the guide plate.

11. The apparatus according to claim 1, wherein the actuator comprises a cam.

12. The image forming apparatus, comprising:

a main body;

a printing unit which is contained in the main body and performs printing for a printing medium;

a frame to form portions of a first feeding path and a second feeding path;

a guide plate to form another portions of the first feeding path and the second feeding path and to move between a first position with the portion and another portion of the first feeding path and a second position to feed the printing medium from the first feeding path toward the second feeding path of the frame and the guide plate being actuated by interllockingly rotation with non-gear structure; and a contact unit disposed on the guide plate to lift the printing medium from a portion of the guide plate.

13. The apparatus of claim 12, further comprising:

A deviation prevention unit disposed between the frame and the contact unit to bias the printing medium toward the guide plate.

14. The apparatus of claim 12, further comprising:

a roller disposed to feed the printing medium toward the frame in the second feeding path with the contact unit when the guide plate is in the second position.

15. The apparatus of claim 12, wherein:

the guide plate moves with respect to a portion of the guide plate;

the first feeding path is extended from the portion of the frame to the portion of the guide plate in the first position; and the second feeding path is extended from the portion of the guide plate to the portion of the frame.

16. The apparatus of claim 12, wherein the another portions of the first feeding path and the second feeding path include a common path formed on the guide plate.

17. The apparatus of claim 12, wherein the another portions of the first feeding path and the second feeding path form an angle to correspond to a difference between the first position and the second position of the guide plate.

18. The apparatus of claim 12, wherein the main body comprises a first side and a second side, and the reverse feeding unit receives the printing medium along the first feeding path from the first side toward the second side of the main body and discharges the printing medium along the second feeding path from the second side to the first side of the main body.

19. An image forming apparatus, comprising:

a housing:

a printing unit to print a printing medium and to feed the printed printing medium from a first side of the housing to a second side of the housing; and a reverse-feeding unit disposed between the first side and the second side of the housing to receive the printed printing medium from the printing unit and to discharge toward the first side of the housing, the reverse-feeding unit comprising:

a frame to form portions of a first feeding path and a second feeding path;

a guide plate to form another portions of the first feeding path and the second feeding path and to move between a first position with the portion and another portion of the first feeding path and a second position to feed the printing medium from the first feeding path toward the second feeding path of the frame, the guide plate being actuated by interlockingly rotation with non-gear structure;

a contact unit disposed on the guide plate to lift the printing medium from a portion of the guide plate.

* * * * *